US006200249B1

(12) United States Patent
Fukuda

(10) Patent No.: US 6,200,249 B1
(45) **Date of Patent: *Mar. 13, 2001**

(54) APPARATUS FOR PULLING CYLINDRICALLY FORMED FILM FOR A BAG MAKER-PACKAGING MACHINE

(75) Inventor: Masao Fukuda, Shiga (JP)

(73) Assignee: Ishida Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/887,360

(22) Filed: Jul. 2, 1997

Related U.S. Application Data

(63) Continuation-in-part of application No. 08/678,638, filed on Jul. 10, 1996, now abandoned.

(30) Foreign Application Priority Data

Aug. 11, 1995 (JP) ..... 7-227217
Sep. 26, 1996 (JP) ..... 8-275551

(51) Int. Cl.[7] ..... B65B 9/08
(52) U.S. Cl. ..... 493/186; 53/451; 53/551
(58) Field of Search ..... 53/451, 551, 552, 53/554; 493/8, 3, 20, 17, 19, 24, 29, 34, 186, 189, 193–197, 199, 206, 207, 208, 209, 924

(56) References Cited

U.S. PATENT DOCUMENTS 4,660,356 * 4/1987 Simionato ..... 53/554 X
5,125,217 * 6/1992 Fukuda ..... 53/551
5,377,474 * 1/1995 Kovacs et al. ..... 53/451 X

* cited by examiner

*Primary Examiner*—David A. Scherbel
*Assistant Examiner*—Anthony Ojini
(74) *Attorney, Agent, or Firm*—Coudert Brothers

(57) ABSTRACT

A pair of pull-down belts pulls longitudinally a tubularly formed elongated bag-making film along a filling cylinder of a bag maker-packaging machine. A pair of members supporting the pull-down belts can move towards or away from each other depending on the size of the former, and elastic springs for providing each of the pull-down belts with a force which depends on their relative positions with respect to the corresponding belt-supporting members. An adjustment motor moves the pull-down belts initially to specified reference positions separate from the tubularly formed film and therefrom towards the filling cylinder. The distance traveled by the pull-down belts from their reference positions towards the filling cylinder is monitored. The distance by which the pull-down belts must be moved for each of different kinds of former is measured and stored in a memory device. Thus, whenever a particular former is selected and installed, the pull-down belts can be automatically moved to optimum positions for pulling down the film effectively by controlling the adjustment motor.

31 Claims, 4 Drawing Sheets

APPARATUS FOR PULLING CYLINDRICALLY FORMED FILM FOR A BAG MAKER-PACKAGING MACHINE

This is a continued prosecution application of application Ser. No. 08/887,360, filed Jul. 2, 1997, which is a continuation-in-part application of application Ser. No. 08/678,638, filed Jul. 10, 1996 now abandoned.

BACKGROUND OF THE INVENTION

This invention relates to an apparatus, generally referred to as a pull-down belt, for pulling a cylindrically formed bag-making material for a bag maker-packaging machine. More particularly, this invention relates to such a bag maker-packaging machine having an improved positioning mechanism for its pull-down belts.

A bag maker-packaging machine, for example, of a so-called vertical pillow type, is generally adapted to bend an elongated web of a thermoplastic flexible bag-making material (hereinafter referred to as "the film") into a cylindrical form around a filling cylinder by means of a component known as the former, to simultaneously seal together its mutually overlapping side edge parts and to use a pair of pull-down belts to pull it further down to a transverse sealer for sealing the cylindrically formed film transversely to the direction of its motion. The filling cylinder is for the purpose of dropping articles therethrough to be packaged, and a plurality of formers with different sizes are usually made available for handling films with different widths and different ways of sealing. Most pull-down belts which have been used for this purpose are of the type which will forcefully compress the film between the belt and the filling cylinder while the film is being pulled downward. Pull-down belts of this type have the disadvantage that a roller or a slidable plate is required to be buried inside the filling cylinder, thereby narrowing the available passage for the articles dropped therethrough. With pull-down belts of this type, furthermore, it has been difficult to programmatically adjust the contact pressure.

The present inventor has disclosed, in Japanese Patent Publication Tokkai 5-4609, another type of pull-down belt adapted to pull down a film while causing it to be pulled toward the belt surface by creating a negative pressure condition. Pull-down belts of this type are able to overcome the problems of the kind described above, but they have different problems such as not being able to pull the film effectively if the gap between the belt and the film is either too large or too small because the suction force by the negative pressure may weaken, or cause a zigzag motion of the film if the gaps between the film and the pair of belts on opposite sides thereof are not equal.

SUMMARY OF THE INVENTION

It is an object of this invention to overcome all these problems of prior art pull-down belts, by providing a new apparatus capable of transporting a cylindrically formed film while pressing the film evenly and lightly such that the friction force generated thereby with the film will not be strong enough to pull it down.

It is another object of this invention to provide an improved bag maker-packaging machine capable of causing its pull-down belts to come into contact with the film every time in an optimum condition on the basis of the measured distance between specified reference positions for the belts and the surface of the film.

It is a further object of this invention to provide such an improved bag maker-packaging machine capable of causing its pull-down belts to come into contact with the film every time in an optimum condition by an effect of learning.

An apparatus embodying this invention, with which the above and other objects can be accomplished, may be characterized as comprising a pair of pull-down belts for pulling a cylindrically formed film along a filling cylinder, a pair of belt-supporting members adapted to move towards or away from each other depending on the size of the former, and elastic springs for providing each of the pull-down belts with a force which depends on the relative positions of the pull-down belts with respect to the corresponding belt-supporting members. An adjustment motor is adapted to move the pull-down belts initially to specified reference positions and therefrom towards the filling cylinder. The distance traveled by the pull-down belts from their reference positions towards the filling cylinder is monitored. The distance to be moved for each of different kinds of former is measured and stored in a memory device. Thus, whenever a particular former is selected and installed, the pull-down belts can be automatically moved to optimum positions for pulling the film down effectively by controlling the adjustment motor.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 3:
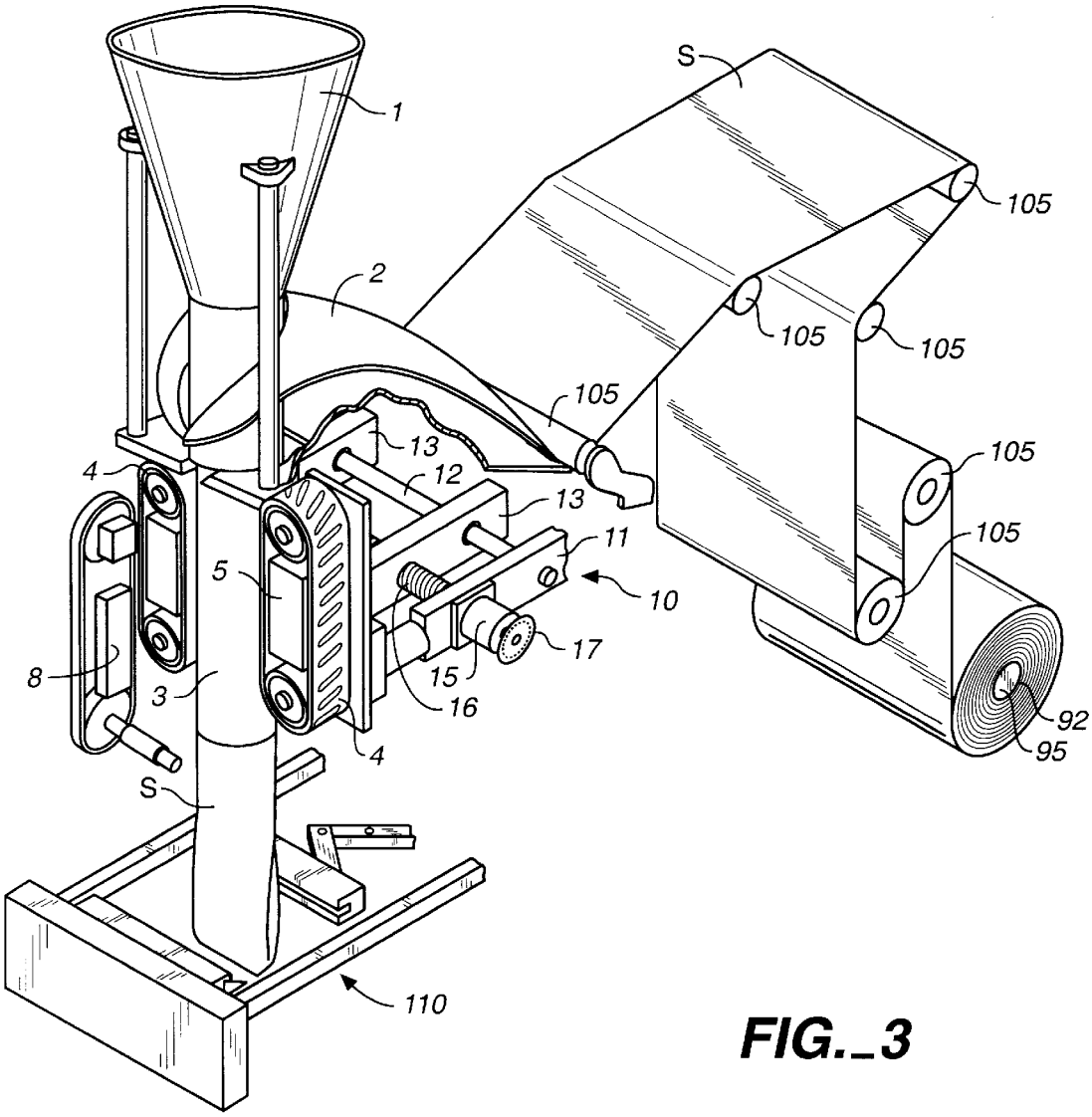
FIG. 3 is a diagonal external view of a vertical pillow type packaging machine incorporating the mechanism embodying this invention.

FIG. 3 shows schematically a bag maker-packaging machine of a vertical pillow type, which incorporates the present invention. A flexible, elongated thermoplastic bag-making material (the film S) is originally in the form of a web roll 92 supported around a shaft 95 (serving as web supporting means). The film S is pulled out of the web roll 92 by a pair of pull-down belts 4 and guided by a plurality of guide rolls (including dancer rollers) 105 to a former 2 disposed below a hopper 1. The function of the former 2 is to bend the film S into a tubular shape, and the tubularly shaped film S is then pulled downward along the peripheral surface of a filling cylinder (sometimes also referred to as a former tube) 3 towards a transverse sealer 110. The transverse sealer 110 is for horizontally (that is, transversely to the downward motion of the film S) sealing the film S such that a batch of articles which is dropped simultaneously through the hopper 1 can be sealed inside the bag being formed. Each of the pair of pull-down belts 4 is provided with a suction chamber 5 connected to a negative pressure source (not shown) while longitudinal seal parts of the film S are sealed together by means of a longitudinal sealing jaw 8 (shown somewhat removed from the filling cylinder 3 for clarity). There is also provided an adjustment mechanism 10 for causing the pair of pull-down belts 4 to move towards or away from each other according to the size of the former 2 which is currently installed. The adjustment mechanism 10 comprises a pair of elongated mutually parallel belt-supporting members 13, disposed in a side-by-side relationship, each supporting a corresponding one of the pull-down belts 4 and being supported so as to be horizontally slidable along a guide rod 12 having both its ends supported by main frames 11 (only one of them shown) of the apparatus. This pair of belt-supporting members 13 can be moved towards or away from each other in a mutually coordinated manner by means of a turnbuckle 16 adapted to be driven by an adjustment motor 15 disposed on one side of the main frames 11.

Figure 1:
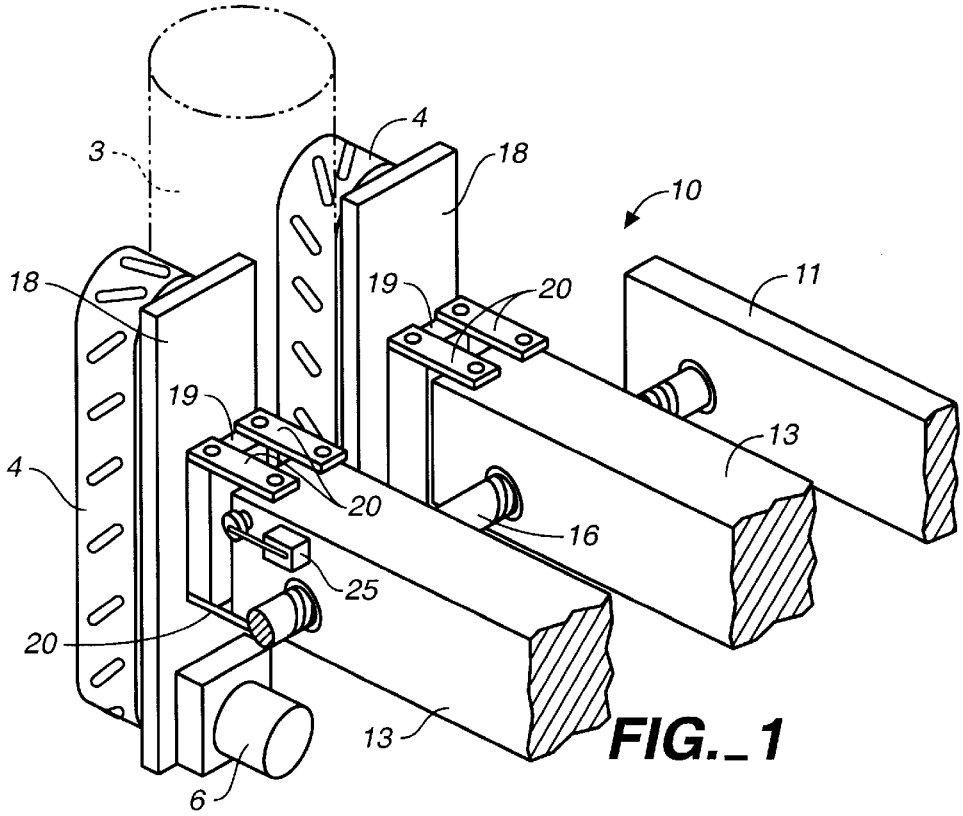
FIG. 1 is a diagonal view of a portion of a film transporting mechanism embodying this invention.
Figure 2:
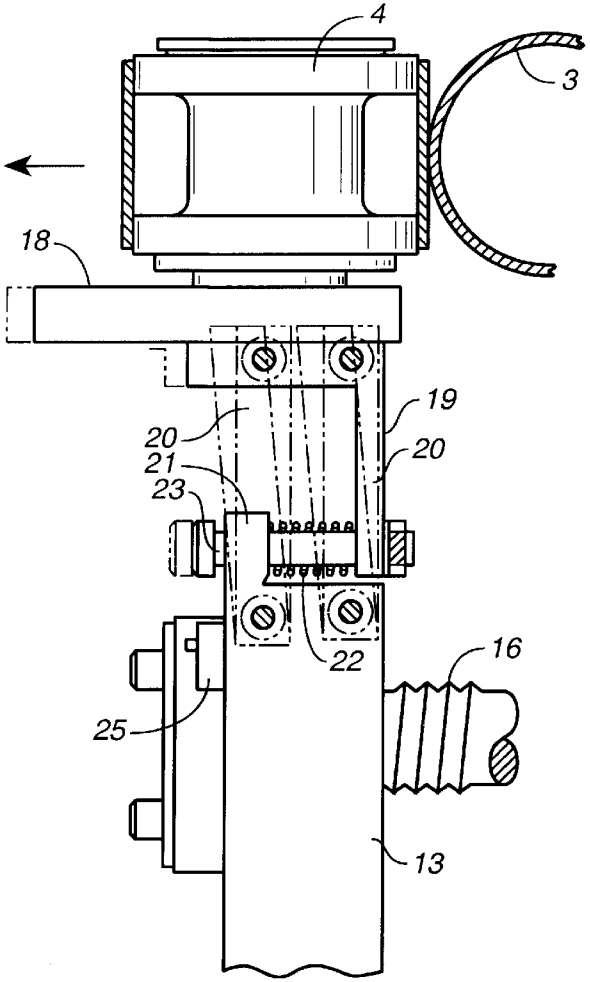
FIG. 2 is a plan view of a portion of the film transporting mechanism of FIG. 1.

As shown in FIGS. 1 and 2 in detail, there is a fine-adjustment mechanism at one end of the supporting members 13. Each pull-down belt 4 and a belt-driving motor 6 therefor are both supported by a belt-supporting plate 18, and an L-shaped (when seen from above, as shown in FIG. 2) block 19 is attached to its back surface (away from the belt 4). This assembly is referred to below as "the pull-down belt unit". This L-shaped block 19 and one end part of a corresponding one of the pair of belt-supporting members 13 are connected to each other by means of a parallelogram linkage mechanism formed with a pair of elongated connectors 20 connected so as to remain parallel. A forward protrusion 21 is formed from each belt-supporting member 13, and a weak elastic spring 22 is inserted between this protrusion 21 and the L-shaped block 19 such that the pull-down belt 4 is normally supported at its neutral (unloaded) position.

There is a position-indicating rod 23 attached to the L-shaped block 19, penetrating through and protruding to one side of the belt-supporting member 13. A limit switch 25 is attached to the belt-supporting member 13 for detecting the distance of this protrusion and outputting a stop signal for stopping the adjustment motor 15 according to this distance of protrusion. The position-indicating rod 23 and the limit switch 25 may be together also referred to as the position-indicating means.

Figure 4:
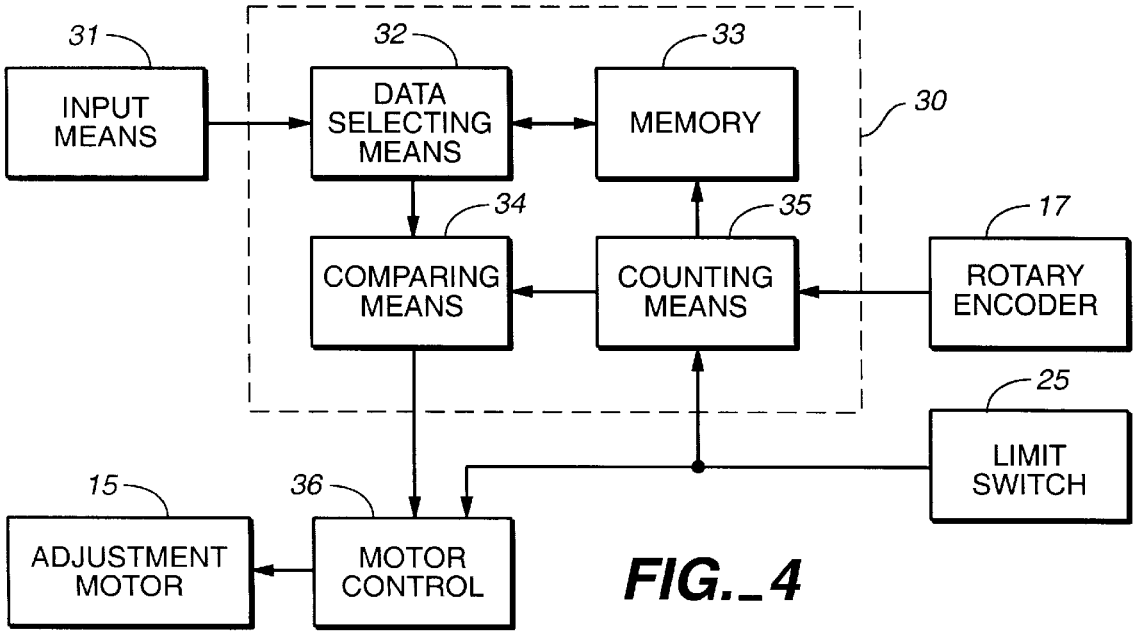
FIG. 4 is a block diagram of the control unit for the packaging machine of FIG. 3.

FIG. 4 shows a control unit 30 for the adjustment mechanism 10 including a memory device 33, comparing means 34, data selecting means 32 and a counting means 35. The counting means 35 is for counting the number of rotations of the adjustment motor 15, on the basis of outputted pulse from an encoder 17 attached to its shaft, representing the distance travelled by the pull-down belts 4 from their reference positions, which are pre-specified positions for the pull-down belts 4 separate from the filling cylinder 3, until a stop signal is received from the limit switch 25. The memory device 33 is for storing data received from the counting means 35 counted for each type of former. The data selecting means 32 is for receiving signals from an external input means 31 such as a keyboard or a touch panel through which necessary data can be inputted by the user, selectively retrieving data which are stored in the memory device 33 for each former and transmitting them to the comparing means 34. The comparing means 34 is for comparing data received from the data selecting means 32 with the count data from the counting means 35 and outputting a deceleration signal to a motor control device 36 immediately before their coincidence to thereby cause the adjustment motor 15 to decelerate and a stop signal at the time of their coincidence to thereby stop the motion of the adjustment motor 15.

Figure 6:
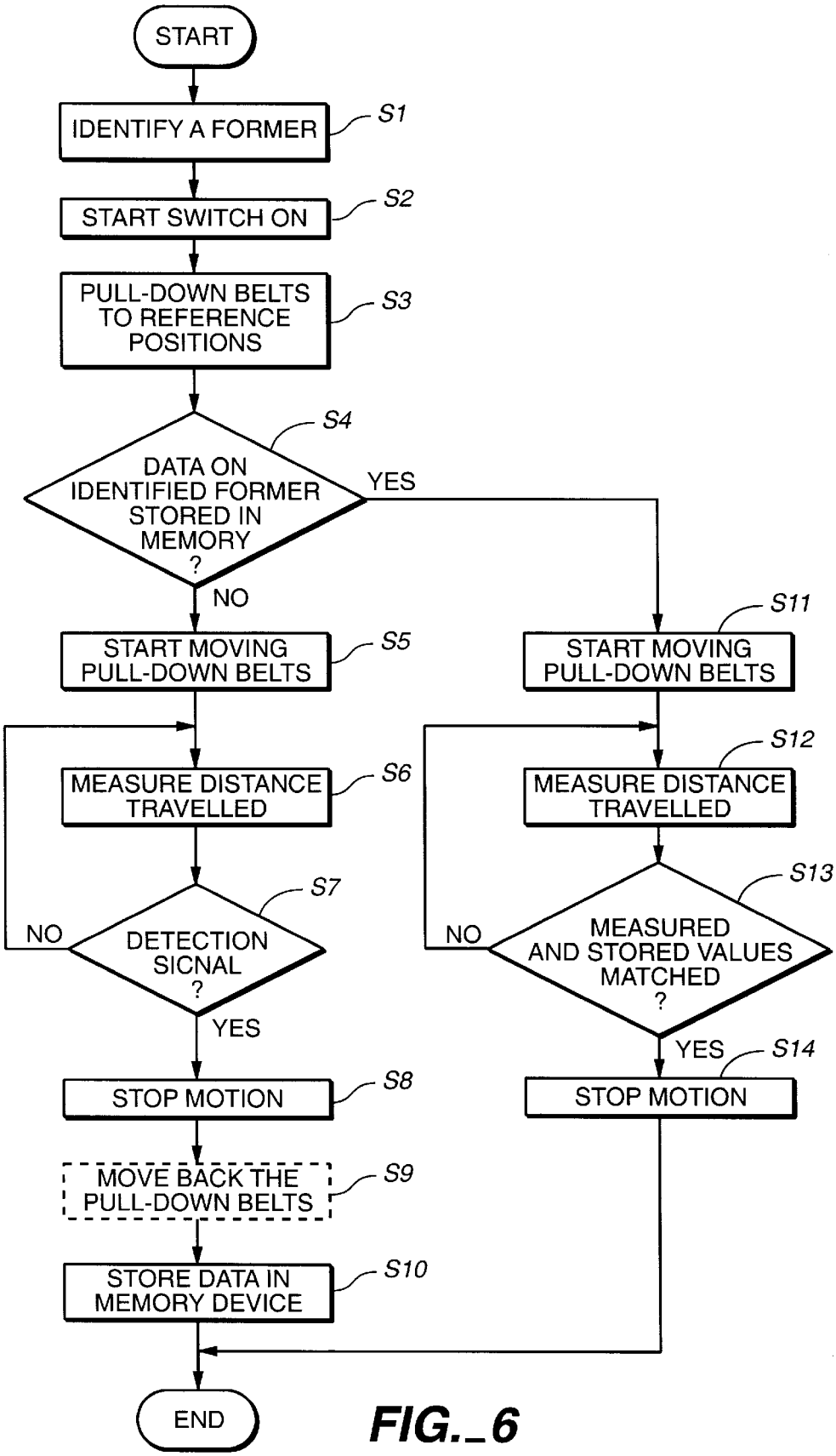
FIG. 6 is a flow chart of the operation of the packaging machine of FIG. 4 according to this invention.

Operations of the apparatus thus structured will be explained next with reference to the flow chart shown in FIG. 6.

First, a former 2 and a film roll appropriate for the packages to be produced are selected and installed on the machine and the film S is pulled out of the roll to the filling cylinder 3. The identification of this selected former 2 is inputted through the input means 31 (say, by key operations) to the memory device 33 (Step Sl), and a start switch (not shown) is thereafter switched on (Step S2) to activate the adjustment motor 15 and to move the pair of belt-supporting members 13 engaged with the turnbuckle 16 such that the pull-down belts 4 go back to their specified reference positions (Step S3).

Let us assume firstly that data on the former 2 which has just been installed were not stored in the memory device 33 (NO in Step S4). In this situation, the pull-down belts 4 are moved from their reference positions towards the filling cylinder 3 (Step S5), while the distance travelled by them are monitored by counting the number of pulses received from the rotary encoder 17 (Step S6). As the pull-down belts 4, attached to the belt-supporting members 13 through the aforementioned linkage mechanism and hence movable with respect thereto, come lightly into contact with the film S moving along the outer surface of the filling cylinder 3, they are each against the elastic force of the associated one of the springs 22, and the film S can be easily pulled down by the pull-down belts 4 because it is being adsorbed to their inwardly-facing surfaces, not because of friction between the pull-down belts 4 and the film S. After the pull-down belts 4 are thus positioned, the limit switch 25 on either of the supporting members 13 will detect the protruding position-indicating rod 23 and output a detection signal to the counting means 35 to stop its counting and to the adjustment motor 15 to stop its rotation (YES in Step S7), causing the adjustment motor 15 to stop and hence also the motion of the pull-down belts 4 towards the filling cylinder 3 (Step S8). The number of the counted pulses, representing the distance between the reference positions of the pull-down belts 4 and where they are thus stopped, is then stored in the memory device 33 (Step S10).

Although not separately shown, a manually adjusting mechanism may be employed, in addition to the adjustment motor 15, to move the pull-down belts 4 forward and backward in a step-wise fashion. If such a mechanism is incorporated, the pull-down belts 4 may be manually pulled back (Step S9), after they come into contact with the film and their motion is stopped in Step S8, to optimum positions for supporting the film S by the suction force.

If data on the installed former 2 are already stored in the memory device 33 (YES in Step S4), the number of pulse counts representing the distance travelled to such a lightly contacting position in the case of this former 2 is retrieved from the memory device 33 to the comparing means 34. As the pull-down belts 4 are moved towards the filling cylinder 3 (Step S11), the count numbers of the pulses transmitted from the rotary encoder 17 are sequentially received by the comparing means 34 (Step S12). When the received count number matches this retrieved value corresponding to the former 2 (YES in Step 13), a match signal is outputted from the comparing means 34. The motor control device 36, upon receiving this match signal from the comparing means 34, stops the adjustment motor 15 and hence the motion of the pull-down belts 4 towards the filling cylinder 3 (Step S14), thereby causing the pull-down belts 4 to lightly contact the film S around the filling cylinder 3 by a learning effect and allowing the film S to be pulled down by the suction force of the pull-down belts 4 towards the transverse sealer 110 shown in FIG. 3, as explained above.

This routine is repeated for each available former 2 with a different size such that an optimum position of the pull-down belts 4 corresponding to each former 2 can be preliminarily stored by a learning process in the memory device 33 in terms of pulse counts counted by the counting means 35. After all these data are stored in the memory device 33, the operator has only to specify the former 2 (or its size), say, on a touch panel serving as the input means 31. The data selecting means 32 thereupon retrieves from the memory device 33 a corresponding data item for the specified former and transmits it to the comparing means 34. Based on this data item and the number counted by the counting means 35, the control unit 30 outputs a signal immediately before their coincidence will occur and another signal at the time of their coincidence, as explained above, to decelerate and stop the adjustment motor 15 without relying on the outputs from the limit switch 25 such that the two pull-down belts 4 are correctly positioned. When an operation is once interrupted and then restarted, the pull-down belts 4 are first returned to their reference positions and can then be automatically and reliably set at their optimum contact positions with the film S.

Figure 5:
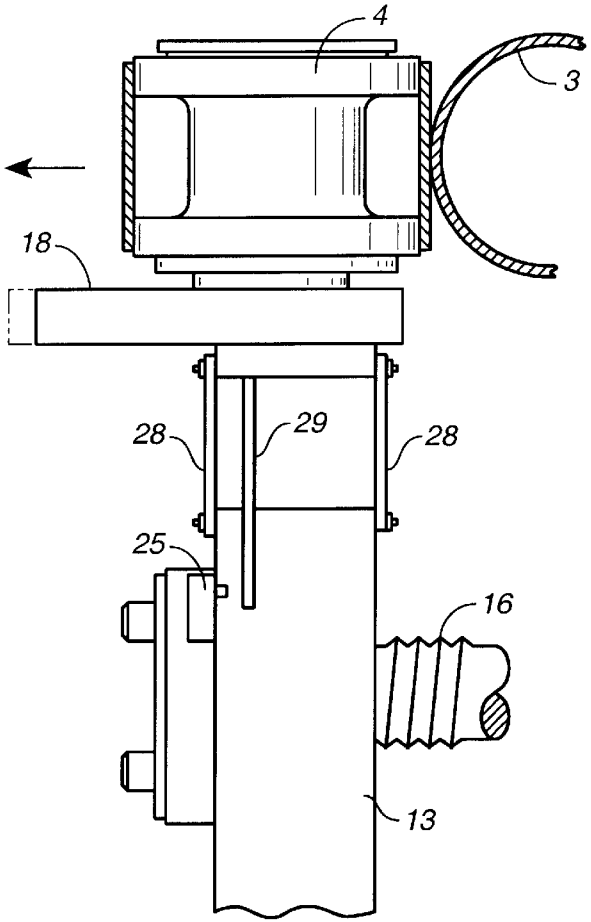
FIG. 5 is a plan view of a portion of another film transporting mechanism embodying this invention.

The invention has been described above with reference to only one example, but this example is not intended to limit the scope of the invention. Many modifications and variations are possible within the scope of the invention. For example, this invention is applicable also to the type of bag maker-packaging machine having no filling cylinder to keep the tubularly formed film open such that articles dropped from above can easily pass therethrough. The tubularly formed film in such a case is kept open by adsorption onto pull-down belts each provided with a suction chamber connected to a negative pressure source, and a longitudinally elongated backing plate may be provided such that the longitudinal sealing jaw can press the film against it for effecting the longitudinal sealing. Although a linkage mechanism with a weak elastic spring was disclosed above as an example of fine-adjustment mechanism, this may be replaced by a simple structure using a pair of simple plate springs, as shown at 28 in FIG. 5, in which other components which are substantially similar to those shown in FIG. 2 are indicated by the same numerals. Numeral 29 indicates an elongated member adapted to move with the belt-supporting plate 18 and to activate the limit switch 25 for controlling the deactivation of the adjustment motor 15. The contact pressure between the pull-down belts 4 and the filling cylinder 3 may be adjusted by providing proximity switches where their contacts are to occur and reversing the direction of rotation of the adjustment motor 15 after a detection signal is outputted from them. Moreover, the invention is applicable also to the kind of bag maker-packaging machine having only one pull-down belt (instead of a pair facing each other and at a 90 degree position from the longitudinal sealing jaw 8, as shown in FIG. 2) disposed opposite the longitudinal sealing jaw 8. In summary, all such modifications and variations that may be apparent to a person skilled in the art are intended to be within the scope of this invention.

What is claimed is:

1. An apparatus for pulling a cylindrically formed bag-making material for a bag maker-packaging machine, said apparatus comprising:

a pair of pull-down belt units each including a pull-down belt for pulling said bag-making material in a longitudinal direction;

a pair of belt-supporting members which move towards or away from each other in a mutually coordinated manner, each supporting and being attached to a corresponding one of said pull-down belt units such that said corresponding pull-down belt unit is movable as a whole relative thereto;

force-applying means for applying a variable force between said bag-making material and each of said pull-down belts by changing the relative position between said each pull-down belt and said corresponding one of said belt-supporting members; and position-indicating means attached to at least one of said belt-supporting members for indicating distance between said belt-supporting members.

2. The apparatus of claim 1 further comprising parallelogram linkage mechanisms each serving to change said relative position, each of said pull-down belt units being attached to a corresponding one of said belt-supporting members through one of said linkage mechanisms.

3. The apparatus of claim 1 further comprising a motor means for moving said pair of belt-supporting members selectably towards or away from each other, said motor means is automatically stopped when said pull-down belts are at specified positions relative to said belt-supporting members.

4. The apparatus of claim 3 further comprising a control unit for storing data on the separation between said pair of belt-supporting members for each of a plurality of different formers usable on said bag maker-packaging machine and controlling said motor means according to said stored data.

5. The apparatus of claim 3 wherein the friction force between said bag-making material and said pull-down belts at said specified positions is not strong enough to pull said bag-making material in said longitudinal direction.

6. The apparatus of claim 1 wherein said pull-down belts are supported mutually opposite to each other with respect to said longitudinal direction.

7. The apparatus of claim 1 wherein said belt-supporting members are elongated and parallel to each other in a specified direction which is transverse to said longitudinal direction, said pull-down belt units moving transversely to said specified direction selectably towards or away from each other.

8. A film transporting mechanism for pulling a cylindrically formed bag-making material in a longitudinal direction for a bag maker-packaging machine, said film transporting mechanism comprising:

a pair of pull-down belt units each including a pull-down belt for pulling said cylindrically formed bag-making material in said longitudinal direction;

a pair of belt-supporting members each supporting and being attached to a corresponding one of said pull-down belt units such that said corresponding pull-down belt unit is movable as a whole relative thereto;

a motor means for moving said pair of belt-supporting members selectably towards or away from each other in a mutually coordinated manner;

force-applying means for applying a variable force between said bag-making material and each of said pull-down belts by changing the relative position between said each pull-down belt and said corresponding one of said belt-supporting members; and position-indicating means attached to at least one of said belt-supporting members for indicating distance between said belt-supporting members.

9. The film transporting mechanism of claim 8 further comprising parallelogram linkage mechanisms each serving to change said relative position, each of said pull-down belt units being attached to a corresponding one of said belt-supporting members through one of said linkage mechanisms.

10. The film transporting mechanism of claim 8 wherein said motor means is automatically stopped when said pull-down belts are at specified positions relative to said belt-supporting members.

11. The film transporting mechanism of claim 10 further comprising a control unit for storing data on the separation between said pair of belt-supporting members for each of a plurality of different formers usable on said bag maker-packaging machine and controlling said motor means according to said stored data.

12. The film transporting mechanism of claim 10 wherein the friction force between said bag-making material and said pull-down belts at said specified positions is not strong enough to pull said bag-making material in said longitudinal direction.

13. The film transporting mechanism of claim 8 wherein said pull-down belts are supported at mutually opposite positions with respect to said longitudinal direction.

14. The film transporting mechanism of claim 8 wherein said belt-supporting members are elongated and parallel to each other in a specified direction which is transverse to said longitudinal direction, said pull-down belt units moving transversely to said specified direction selectably towards or away from each other.

15. An apparatus for pulling a cylindrically formed bag-making material in a longitudinal direction with a pull-down belt for a bag maker-packaging machine, said apparatus comprising:

a belt-supporting member which supports and is attached to said pull-down belt such that said pull-down belt is movable as a whole relative thereto and is movable towards or away from said cylindrically formed bag-making material being transported in said longitudinal direction;

force-applying means for applying a variable force between said bag-making material and said pull-down belt by changing the relative position between said pull-down belt and said belt-supporting member; and position-indicating means attached to said belt-supporting member for indicating position of said belt-supporting member.

16. The apparatus of claim 15 further comprising a parallelogram linkage mechanism, said pull-down belt being attached to said belt-supporting member through said linkage mechanism.

17. The apparatus of claim 15 further comprising a motor means for moving said belt-supporting member selectably towards or away from said cylindrically formed bag-making material being transported in said longitudinal direction, said motor means being automatically stopped when said pull-down belt is at a specified position relative to said belt-supporting member.

18. The apparatus of claim 17 further comprising a control unit for storing data on the separation between said belt-supporting member for each of a plurality of different formers usable on said bag maker-packaging machine and controlling said motor means according to said stored data.

19. The apparatus of claim 15 wherein said belt-supporting member is elongated transversely to said longitudinal direction, said pull-down belt moving transversely to said specified direction selectably towards or away from said bag-making material.

20. A bag maker-packaging machine for bending an elongated bag-making film into a tubular shape to form a bag and simultaneously filling said bag with a batch of articles, said bag maker-packaging machine comprising:

a web supporting means supporting a web roll having a web of said elongated film wound around a core shaft;

a former for forming said web into a tubular shape;

web guiding means for guiding said web from said web roll to said former and said tubularly formed web on a longitudinal downward film path;

a longitudinal sealer for sealing side edges of said tubularly formed web longitudinally;

a pair of pull-down belts for causing said film to move on said downward film path; and a transverse sealer for sealing said longitudinally sealed film in a direction transverse to said film path;

said film pulling means comprising a pair of belt-supporting members which are movable towards or away from each other in a coordinated manner, each supporting and being attached to a corresponding one of said pull-down belts such that said corresponding pull-down belt is movable as a whole relative thereto, and force-applying means for applying a variable force between said bag-making material and each of said pull-down belts by changing the relative position between said each pull-down belt and said corresponding one of said belt-supporting members, there being provided position-indicating means attached to at least one of said belt-supporting members for indicating distance between said belt-supporting members.

21. The bag maker-packaging machine of claim 20 further comprising a motor means for moving said pair of belt-supporting members selectably towards or away from each other.

22. A bag maker-packaging machine for bending an elongated bag-making film into a tubular shape to form a bag and simultaneously filling said bag with a batch of articles, said bag maker-packaging machine comprising:

a web supporting means supporting a web roll having a web of said elongated film wound around a core shaft;

a former for forming said web into a tubular shape;

web guiding means for guiding said web from said web roll to said former and said tubularly formed web on a longitudinal downward film path;

a longitudinal sealer for sealing side edges of said tubularly formed web longitudinally;

a pull-down belt for causing said film to move on said downward film path;

a belt-supporting member which supports and is attached to said pull-down belt such that said pull-down belt is movable as a whole relative thereto and is movable towards or away from said cylindrically formed film being transported on said downward film path;

force-applying means for applying a variable force between said bag-making material and said pull-down belt by changing the relative position between said pull-down belt and said belt-supporting member;

position-indicating means attached to said belt-supporting member for indicating position of said belt-supporting member; and a transverse sealer for sealing said longitudinally sealed film in a direction transverse to said film path.

23. A bag maker-packaging machine comprising:

a former for forming an elongated bag-making film into a tubular shape;

pull-down belt units each including a pull-down belt for causing said film to move longitudinally;

belt-supporting members, each supporting and being attached to a corresponding one of said pull-down belt units such that said corresponding pull-down belt is movable as a whole relative thereto;

a longitudinal sealer for sealing side edges of said tubularly formed film longitudinally;

a transverse sealer for sealing said longitudinally sealed film transversely to form a bag;

a belt-driving means for moving said pull-down belt units as a whole from specified reference positions, which are separate from said tubularly formed film, to contact positions at which said pull-down belts are in contact with said tubularly formed film;

a measuring means for measuring a distance by which said pull-down belt units are moved by said belt-driving means; and a control means for causing said pull-down belt units to be moved as a whole from said reference positions to said contact positions, causing said measuring means to thereby obtain a measured distance between said reference positions and said contact positions, and controlling said belt-driving means on the basis of said measured distance.

24. The bag maker-packaging machine of claim 23 including positioning means for positioning said pull-down belt units at said contact positions.

25. The bag maker-packaging machine of claim 23 wherein said control means also serves to identify said former from said measured distance, to store said measured distance as a value associated with said identified former, to retrieve said value and to control said belt-driving means on the basis of both said retrieved value and said measured distance.

26. The bag maker-packaging machine of claim 25 including positioning means for positioning said pull-down belt units at said contact positions.

27. The bag maker-packaging machine of claim 23 further comprising a detector for detecting contact between said pull-down belts and said tubularly formed film, said control means also serving to identify said former from said measured distance, to store a distance value measured by said measuring means until said detector detects said contact as a former-identifying value associated with said identified former, to retrieve said former-identifying value and to control said belt-driving means on the basis of both said retrieved former-identifying value and said measured distance.

28. The bag maker-packaging machine of claim 27 including positioning means for positioning said pull-down belt units at said contact positions.

29. An apparatus for pulling a cylindrically formed bag-making material for a bag maker-packaging machine, said apparatus comprising:

a pair of pull-down belt units each including a pull-down belt for pulling said bag-making material in a longitudinal direction;

a pair of belt-supporting members which move towards or away from each other in a mutually coordinated manner, each supporting and being attached to a corresponding one of said pull-down belt units;

spring-loaded connectors each connecting one of said pull-down belts with an associated one of said belt-supporting members such that relative position therebetween is changeable such that said corresponding pull-down belt unit is movable as a whole relative thereto; and position-indicator attached to at least one of said belt-supporting members for indicating distance between said belt-supporting members.

30. The apparatus of claim 29 wherein said spring-loaded connectors include a spring.

31. The apparatus of claim 29 wherein said spring-loaded connectors include plate springs.

* * * * *